United States Patent [19]

Hilton et al.

[11] 4,417,575

[45] Nov. 29, 1983

[54] RESPIRATORS

[75] Inventors: Joseph R. Hilton, Surrey; John D. Wood, Hertfordshire, both of England

[73] Assignee: Racal Safety Limited, Middlesex, England

[21] Appl. No.: 276,190

[22] Filed: Jun. 22, 1981

[30] Foreign Application Priority Data

Jul. 30, 1980 [GB] United Kingdom ..... 8021879

[51] Int. Cl.[3] ..... A62B 7/10

[52] U.S. Cl. ..... 128/206.19; 128/206.12; 128/206.16; D29/8

[58] Field of Search ..... 128/206.19, 206.12, 128/206.16, 139, 206.24, 206.28, 909; D29/8; 46/1 F; 32/1 R; 2/9, 175, 206

[56] References Cited

U.S. PATENT DOCUMENTS

| | | | |
|---|---|---|---|
| Re. 29,613 | 4/1978 | Kropfhammer | 128/909 |
| 1,292,096 | 1/1919 | Schwartz | 128/202.16 |
| 1,523,884 | 1/1925 | Leduc | 128/139 |
| 1,868,281 | 7/1932 | Falkson | 2/175 |
| 3,971,369 | 7/1976 | Aspelin et al. | 128/206.19 |
| 4,248,220 | 2/1981 | White | 128/206.19 |

FOREIGN PATENT DOCUMENTS

| | | | |
|---|---|---|---|
| 1778 | 7/1900 | Fed. Rep. of Germany | 2/175 |
| 1298420 | 6/1969 | Fed. Rep. of Germany | 128/206.19 |
| 1220851 | 5/1960 | France | 128/139 |
| 7706660 | 12/1977 | Netherlands | 128/206.19 |
| 4787 | 12/1912 | United Kingdom | 128/206.19 |

*Primary Examiner*—Kyle L. Howell
*Assistant Examiner*—Karin M. Reichle
*Attorney, Agent, or Firm*—Laubscher, Philpitt & Laubscher

[57] ABSTRACT

The present invention relates to a filtering facepiece made from flexible filtering sheet material.

The facepiece is made from a flat pocket 100 of filtering sheet material having opposed side walls 105 and 106, a generally tapering shape with an open end 104 at the larger end and a closed end 101 at the smaller end. The edge of the pocket at the closed end is outwardly bowed, e.g. defined by intersecting straight lines and/or curved lines, and the closed end is provided with fold lines 107 defining a surface which is folded inwardly of the closed end of the pocket to define a generally conical inwardly extending recess 108 for rigidifying the pocket against collapse against the face of the wearer on inhalation.

18 Claims, 7 Drawing Figures

RESPIRATORS

BRIEF DESCRIPTION OF THE PRIOR ART

The present invention relates to improvements in respirators and particularly to filtering facepieces.

In co-pending application Ser. No. 276,163 filed June 22, 1981 it is proposed to provide a filtering facepiece which is made from flexible filtering sheet material in the form of a flat pocket of generally frusto-conical sectional shape having an open edge at the larger end of the frusto-cone and a closed end at the smaller end of the frusto-cone. The closed end being defined by a straight line extending between the lateral edges of the pocket. The pocket is provided with fold lines defining a generally quadrilateral surface composed of two triangular surfaces having a common base extending in a direction generally perpendicular to the closed end of the pocket. The triangular surfaces are folded about the fold lines to extend inwardly of the pocket defining a generally V-shaped channel and so that they face each other and are, in use, relatively inclined to each other.

It has been found that, with such a filtering facepiece, the triangular surfaces have a tendency to unfold and revert to their original arrangement obviating the whole point of the triangular areas which is to rigidify the facepiece against collapse against the face of the wearer on inhalation and so that it automatically assumes a shape suitable to accommodate the face of the wearer.

It has now been found that a stronger and more stable arrangement can be produced in which the inwardly extending surfaces are so arranged as to have in effect an over-centre action when being folded to their inwardly extending position. In that position the surfaces define a generally conical recess in the closed end of the facepiece, rather than the simple V-shaped channel of the facepiece of the above referred to co-pending application Ser. No. 276,163.

SUMMARY OF THE INVENTION

Thus according to the present invention there is provided a filtering facepiece made from flexible filtering sheet material in the form of a flat pocket having opposed side walls, of generally tapering shape with an open end at the larger end of the pocket and a closed end at the smaller end of the pocket, wherein the edge of the flat pocket at the closed end is outwardly bowed and the closed end of the pocket is provided with first fold lines defining a surface which is folded inwardly of the pocket to define in use a generally conical recess extending inwardly of the pocket.

The closed, outwardly bowed, end of the flat pocket may have an edge which is defined by a curve, e.g. part of the circle, or by two or more intersecting straight lines so that it is generally conical, or by a combination of these two.

The closed end of the pocket may merge continuously or discontinuously with the lateral edges of the flat pocket. For example the side walls of the flat pocket may comprise a first portion providing the open end of the pocket which has the general shape of a section of a frusto-cone and a second portion which has the general shape of a section of a cone, the cone of the second portion having a larger cone angle than that of the first portion, the closed end of the pocket being provided by part or all of the second portion, alternatively the second portion may be generally arcuate, e.g. provided by a segment of a circle.

Preferably, the first portion providing the open end of the pocket has the shape of a section of a frusto-cone having a cone angle of about 60°.

Preferably the surface defined by the first fold lines is a quadrilateral surface and is composed of two identical pairs of triangular surface portions each triangular surface portion having two adjacent sides common with the other triangular surface portions, the pairs of triangular surface portions facing each other and being in use relatively inclined to each other and defining a generally pyramidical recess.

Advantageously the fold lines defining the quadrilateral surface are longitudinally rigidified and the fold lines defining the common sides of the triangular surface portions may also be longitudinally rigidified.

Such a filtering facepiece may be designed to be worn with one side wall overlying the nose of the wearer and with the other side wall underlying the chin of the wearer. With such an arrangement, the common sides of the identical pairs of triangular surface portions extend in a generally vertical plane, and the fold lines defining these common sides on the opposed side walls may be extended to the open edge of the pocket providing fold lines running along the crest of the nose and the centre line of the chin.

The one side wall may be provided with two further fold lines extending one from each lateral corner of the quadrilateral surface to the open edge of the pocket intermediate the centre and lateral extremity thereof to define a channel for receiving the nose of the wearer.

A deformable element may be provided extending along the edge of the one side wall between these further fold lines, the deformable element being initially bent to a generally U-shape and being intended to be shaped by the wearer to conform to the shape of the bridge of the nose of the wearer.

The filtering facepieces described above and hereafter are made from flexible filtering sheet material which may have particulate and/or gas or vapour filtering capabilites and may operate on the basis of mechanical and/or electrostatic and/or absorption and/or adsorption filtering of particles and/or molecules. For example, for particulate filtering, the material may comprise or be composed of fibres, typically cellulose fibres with added short glass fibres, or of glass fibres, made up into paper or a felt-like material, or microfibres having both electrostatic and mechanical efficiency and which may be made of P.V.C. or a polycarbonate, or another filter material. For gas or vapour filtering, the material may comprise or be composed of charcoal, for example in the form of cloth, or a charcoal impregnated material. Such gas or vapour filtering material may be combined with a particulate filtering material as required. The filtering material may be contained between two scrim sheets of low efficiency which play no effective part in the filtration.

BRIEF DESCRIPTION OF THE INVENTION

The invention will be more fully understood from the following description of embodiments thereof given by way of example only, with reference to the accompanying drawings.

DETAILED DESCRIPTION

Figure 1:
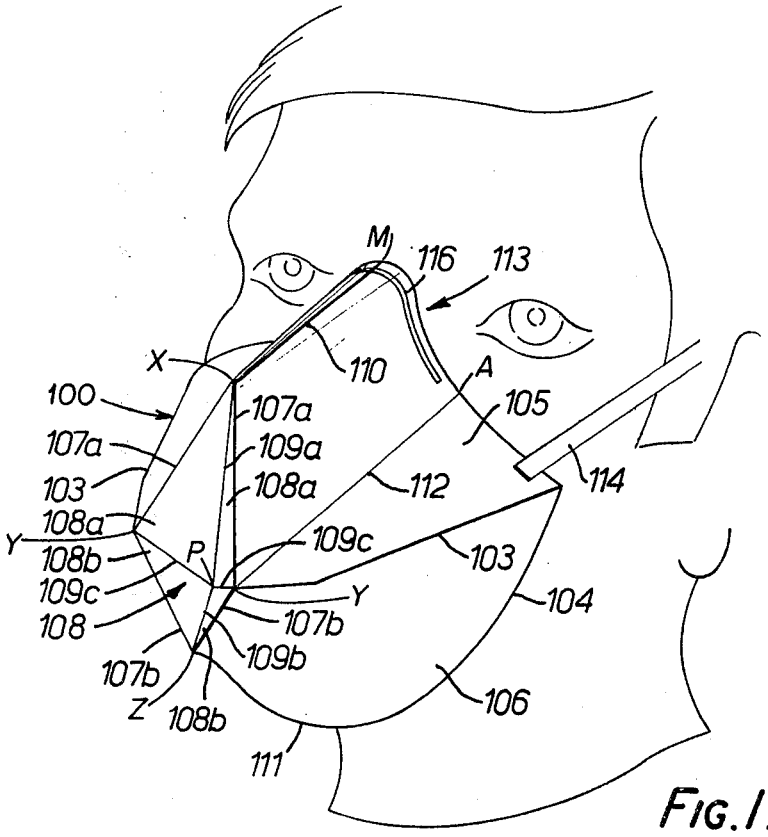
FIG. 1 is a perspective view of an embodiment of a facepiece according to the present invention, in use.
Figure 2:
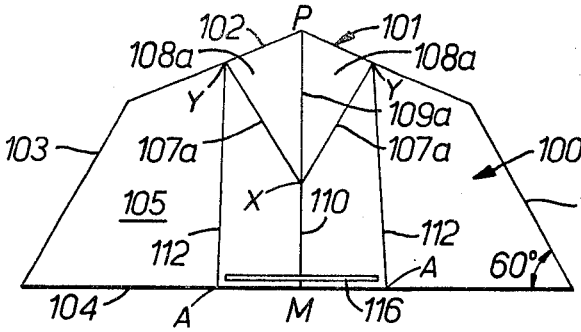
FIG. 2 is a plan view from one side of a flat pocket for use in making the facepiece of FIG. 1.
Figure 3:
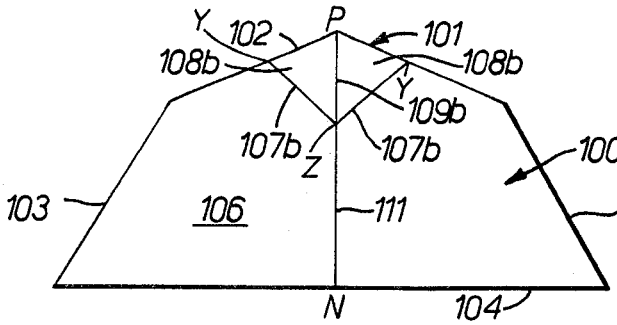
FIG. 3 is a plan view from the other side of the flat pocket of FIG. 2.

The facepiece shown in FIG. 1 is made from flexible filtering sheet material as described above and is initially in the form of a flat pocket defined by a cup-shaped member 100, as shown in FIGS. 2 and 3, of generally tapering shape and having a closed end 101 at the smaller end of the pocket which has an outwardly bowed edge 102, closed lateral edges 103 defining a U-shaped horizontal seam and an open edge 104 at the larger end of the pocket. The facepiece is intended to be used with one concave side wall 105, hereafter called the upper wall, overlying the nose of the wearer and the other concave side wall 106, hereafter called the lower wall, underlying the chin of the wearer, the closed lateral edges 103 extending along the sides of the face of the wearer.

A quadrilateral end closure surface 108 defined by fold lines 107*a* and 107*b* at the closed end of the flat pocket defined in cup-shaped 100 is folded, as will be described hereafter, to create a generally conical, in fact pyramidical recess extending inwardly of the pocket at the closed end thereof, the quadrilateral surface being composed of two pairs of substantially triangular surface portions 108*a* and 108*b*, each of which has two of the following sides 109*a*, 109*b* or 109*c* in common, which face each other and which are, in use as shown in FIG. 1, inclined to each other.

The fold lines defining one of the common sides 109*c*, are defined by the outwardly bowed edge 102 of the flat pocket.

The fold lines defining the other common side 109*a* or 109*b*, extend in use generally in a vertical plane and are generally perpendicular to the open edge of the pocket and on the plane of symmetry of the facepiece. Advantageously these fold lines are extended from points X and Z by fold lines 110 and 111 one on each wall of the pocket to the open edge 104 of the pocket. The fold lines 110 and 111 extend, in use, along the crest of the nose and under the chin of the wearer respectively.

In addition, the upper wall 105 of the facepiece may be provided with two further fold lines 112 each extending from points Y at a lateral extremity of the quadrilateral surface to points A at the open edge 104 of the pocket intermediate the fold line 110 and the lateral edges 103 of the pocket. These fold lines 112 together with fold line 110 define in the upper wall 105 an inverted V-shaped channel 113 which seats on the nose of the wearer and positively adapts the upper wall 105 of the pocket to the shape of the wearer's face so as to decrease edge seal leakage around the nose and in the area between the nose and the cheeks.

The facepiece is held on the face by one or more head bands attached to the open edge of the pocket. As shown a single head band 114 is provided.

The production of a facepiece as described above will now be described in connection with filtering sheet material which is weldable, e.g. by high frequency, ultrasonic or heat, welding. The facepiece is made from two blanks of the shape shown in FIGS. 1 and 2 which are welded together along the edges 102 and 103 to create the closed pocket 100. Sealing welds may also be made along the edges of the open end 104 of the pocket to prevent fraying of the material along these edges.

Before, simultaneously with, or after the creation of the closed pocket 100, the fold lines 107, 109 and 110 to 112 are defined. Some or all of these fold lines and the welds along the edges 102 and 103 may be defined by welds which may be simple planar welds having a degree of longitudinal rigidity or welds which are profiled to increase the tendency of the material to fold along the weld and/or to increase the longitudinal rigidity of the fold line. Those fold lines which are not defined by welds may be defined by simple crease lines in the material. In a preferred embodiment fold lines 107 are defined by planar welds and fold lines 109 by profiled welds, fold lines 110 to 112 being defined by crease lines in the material.

Figure 4:
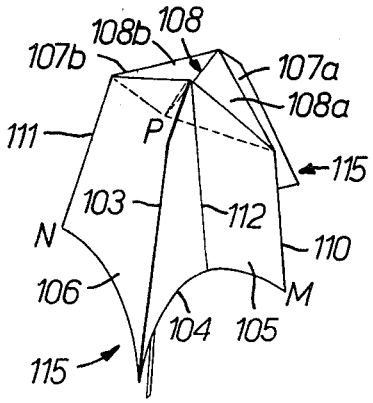
FIG. 4 is a perspective view of a facepiece made from the pocket of FIGS. 2 and 3, at a stage in its production.
Figure 5:
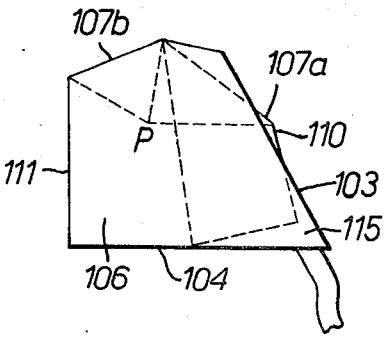
FIG. 5 is a side view of a facepiece made from the flat pocket of FIGS. 2 and 3 when in folded storage condition.

To produce the facepiece shown in FIG. 1 from the flat pocket 100, the pocket is opened by pulling on the ends M, N of the folds 110, 111 and at the same time the junction P of fold lines 109*a* and 109*b* at the closed end 101 is depressed to fold the pocket along the fold lines 107*a* and 107*b* defining the quadrilateral surface to create the inwardly extending conical recess 108 and the triangular surface portions 108*a* and 108*b* (FIG. 4). In depressing point P, which forms the apex of the conical recess 108, and forming the conical recess, it is seen that the quadrilateral surface in effect passes through an over-centre position so that in its final position it is resistant to unfolding and return to its original condition. Further separation of the points M and N brings the pairs of triangular surface portions together, as shown in FIG. 5, and produces triangular wings 115 which are then folded about the fold lines 112 towards the point M to lie flat against the remainder of the pocket, as shown in FIG. 5. At a convenient stage in production of the facepiece, the head band previously described is attached.

During production, a deformable strip 116 may be attached to the edge of the upper wall 105 of the facepiece so as to extend between the fold lines 112 over the fold line 110. When the facepiece is in its flat folded condition as shown in FIG. 5, i.e. its normal storage condition, the strip 116 is bent double about fold line 110.

To use the facepiece, starting with the facepiece in its storage condition as shown in FIG. 5, it is opened out by pulling apart the wings 115 to the condition shown in FIG. 4. The upper wall 5 of the facepiece then automatically assumes the shape suitable for the wearer except that the strip 116 has to be opened out to open the channel 113 to receive the nose of the wearer. The shaping of the upper wall 5 predisposes the facepiece to nestle into the difficult-to-seal areas to either side of the nose of the wearer and the strip 113 is, when the facepiece is on the face of the wearer, fitted to the shape of the nose of the wearer to improve the sealing across the bridge of the nose.

In the facepiece described with reference to FIGS. 1 to 5, the flat pocket of the facepiece has the general shape of a cone comprising a first portion providing the open end of the pocket which has the shape of a section of a frusto-cone, preferably having a cone angle of about 60°, and a second portion which has the shape of a section of a cone, having a larger cone angle than that of the first portion. The closed end of the pocket is provided by part of the second portion so that the closed end edge 102 is outwardly bowed and defined by intersecting straight lines. As previously mentioned this has the effect, when the quadrilateral surface defined by the fold lines 107 is folded inwardly, of creating a generally conical recess 108 which, in being folded into the pocket in effect goes through an over-centre position so that it is securely recessed and does not have a tendency to revert to its original outwardly projecting position. This provides a considerably more stable facepiece than that of the above referred to co-pending application Ser. No. 276,163 and one which has therefore an increased resistance to collapse against the face on inhalation.

Figure 6:
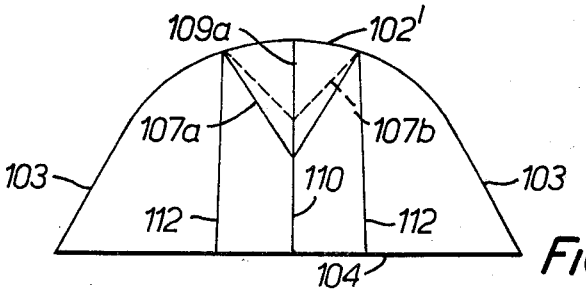
FIGS. 6 and 7 are plan views of flat pockets for other embodiments of facepieces according to the present invention.

This effect can be obtained in other ways, by otherwise bowing the edge 102 of the closed end, for example as shown in FIG. 6, where the closed end edge 102' is curved. In this embodiment the facepiece comprises a first portion providing the open end 104 of the pocket which has the shape of a section of a frusto-cone, as in the embodiment of FIGS. 2 and 3, and a second portion which is curved, for example has the shape of a segment of a circle, part of which forms the closed end of the pocket. With the pocket of FIG. 6, by folding the closed end about the fold lines 107, a conical recess is again provided in the closed end of the pocket.

Figure 7:
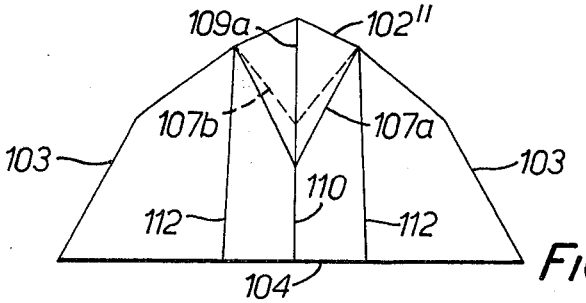

A further variation in the shaping of the pocket is shown in FIG. 7, in which the pocket comprises three portions, the first of which, providing the open end 104 of the pocket, has the shape of a section of a frusto-cone, the intermediate portion also has the shape of a section of a frusto-cone but with a larger cone angle than the first portion, and the second portion, providing the closed end edge 102'' of the pocket has, as shown, the shape of a section of a cone, but may have the shape of a section of a frusto-cone, with a larger cone angle than that of the intermediate portion.

It will be appreciated that the flat pocket of the facepiece may have a variety of other shapes than those described above provided that the edge of the open end included in the quadrilateral surface is outwardly bowed.

The angles included between the fold lines **107*a* and the fold lines 107*b* may be the same or, as shown, different. Preferably the angle between fold lines 107*a* is smaller than the angle between fold lines 107*b***. This has the effect of directing the apex P of the inwardly directed conical recess at the closed end of the pocket downwardly towards the chin of the wearer which better adapts the facepiece to the actual shape of the wearer's face and improves visibility for the wearer.

It has been found that there is an additional advantage in the facepieces described above in relation to that of the above referred to co-pending application Ser. No. 276,163, in that the internal volume of the facepiece can be reduced while the area of the filtering material is maintained substantially constant. In effect more of the filtering material is included in the inverted cone at the closed end of the pocket so that material adjacent the cone can be cut away. An advantage of reducing the internal volume of the facepiece arises from the fact that, in use, there is an apparent heating effect with such facepieces which results from the fact that the exhaled warm air which remains inside the facepiece is subsequently inhaled with the apparent effect that the facepiece is warming the inhaled air. A reduction in the internal volume of the facepiece reduces the amount of exhaled air retained in the facepiece between exhalation and subsequent inhalation and therefore reduces the apparent warming effect. It will however be appreciated that for efficient filtering, the total surface area of filtering material in the facepiece must be maintained at a certain level so that reduction in the internal volume of the facepiece cannot be at the expense of the surface area. The facepiece described herein may include an edge seal as described in the above referred to co-pending application Ser. No. 276,163.

As described above, the facepiece is made of weldable filtering material and is created by welding the material. Whether or not the material is weldable, the facepiece may be made up using other means, e.g. adhesive, and some or all of the fold lines may be defined either by preformed crease lines or for example by applying strips of plastics, e.g. by injection moulding or otherwise, along the fold lines, where these fold lines need to be longitudinally rigidified.

The facepiece described herein, as with the facepiece of the above referred to co-pending application Ser. No. 276,163, can be regarded as comprising a frame defined by the fold lines 107, 109, 110 and 111, between which the filtration material extends. These fold lines can be likened to struts in compression which are pin jointed at their ends. The welds along the lateral edges 103 are under tension during exhalation and may be under compression during inhalation and therefore rigidity in compression is desirable. The strut formed by fold lines 109 is particularly important since this lends stiffness to the facepiece in a vertical position. The pin joints between the struts give the facepiece a degree of flexibility and mobility so that it can easily adapt to fat or thin faces and can accommodate movement of the jaw of the wearer.

What is claimed is:

1. A generally cup-shaped filtering facepiece (100) formed of flexible filtering material adapted to cover the nose and mouth of a user, said facepiece comprising (a) convergent generally frusto-conical side wall means (105, 106) having at its large end a peripheral free edge (104);

(b) end wall means (108) closing the smaller end of said side wall portion, thereby to define a pocket for receiving the nose and mouth of the user with said peripheral edge extending over the nose and under the chin of the user, said end wall means including (1) a plurality of end wall panels (**108*a*, 108*b*) foldably connected with said side wall means by four first fold lines (107*a*, 107*b*) that are interconnected by four apices (X, Y, Z), respectively, said end wall panels being connected with each other by central fold line means (109*a*, 109*b*) that extend between a pair of opposite apices (X, Z), thereby to define between said four interconnected fold lines a generally pyramidical quadrilateral region (108**) having four triangular panels;

(2) said end wall panels being folded inwardly about said four interconnected fold lines to cause said generally pyramidical quadrilateral region to extend reversely within said pocket at the closed end of the facepiece; and (c) means (114) for attaching said facepiece to the wearer's head.

2. A filtering facepiece as defined in claim 1, wherein said central fold line means (109*a*, 109*b*) extend vertically.

3. A filtering facepiece as defined in claim 2, and further including a generally horizontally arranged horizontal seam means (103) dividing said facepiece into upper and lower sections (105, 106).

4. A filtering facepiece as defined in claim 3, wherein said seam means is defined by the arc of a circle.

5. A facepiece as defined in claim 4, wherein said seam means is defined by at least two intersecting lines.

6. A facepiece as defined in claim 4, wherein said seam means is defined by intersecting curved and straight lines.

7. A facepiece as defined in claim 4, wherein said cup-shaped member has a first portion at the open end thereof having a generally frusto-conical cross-sectional configuration and a second portion at the closed end thereof having a generally conical cross-sectional configuration, the angle of the cone of said second portion being greater than the angle of the cone of said first portion.

8. A facepiece as defined in claim 7, wherein said cup-shaped member further comprises an intermediate section between said first and second sections, said intermediate section having a generally frusto-conical cross-section configuration, the angle of the cone of said intermediate portion being between the angles of the cones of said first and second portions, respectively.

9. A facepiece as defined in claim 8, wherein the angle of the cone of said first portion is 60°.

10. A facepiece as defined in claim 3, wherein said horizontal seam divides said center fold line means into upper and lower center fold lines (109*a*, 109*b*) arranged in the vertical plane containing the nose and chin of the user.

11. A facepiece as defined in claim 10, wherein said upper and lower center fold lines and said first pairs of fold lines are longitudinally rigidified.

12. A facepiece as defined in claim 11, wherein said filtering material is weldable, and further wherein said rigidified fold lines are defined by welds in said filtering material.

13. A facepiece as defined in claim 3, wherein said upper section contains second fold line means (110, 112) defining in said side wall means an inverted generally V-shaped channel (113) for receiving the nose portion of the user.

14. A facepiece as defined in claim 13, and further comprising a deformable element (116) having a generally U-shaped configuration and connected with said upper section across said V-shaped channel adjacent said free edge.

15. A facepiece as defined in claim 10, wherein said cup-shaped member is adapted for folding about said upper and lower second center fold lines to a flat configuration for storage thereof.

16. A facepiece as defined in claim 1, wherein said filtering sheet material has particulate and gas filtering capabilities.

17. A facepiece as defined in claim 1, wherein said filtering sheet material includes microfibers having electrostatic efficiency.

18. A facepiece as defined in claim 1, wherein said filtering sheet material includes activated charcoal.

* * * * *